US007670235B2

(12) United States Patent
Lo

(10) Patent No.: US 7,670,235 B2
(45) Date of Patent: Mar. 2, 2010

(54) GOLF CLUB HEAD HAVING REMOVABLE WEIGHT

(75) Inventor: Chih-Wei Lo, Dayuan Township, Taoyuan County (TW)

(73) Assignee: Fu Sheng Industrial Co., Ltd., Taipei (TW)

( * ) Notice: Subject to any disclaimer, the term of this patent is extended or adjusted under 35 U.S.C. 154(b) by 68 days.

(21) Appl. No.: 11/808,715

(22) Filed: Jun. 12, 2007

(65) Prior Publication Data

US 2008/0039229 A1 Feb. 14, 2008

(30) Foreign Application Priority Data

Aug. 9, 2006 (TW) ..... 95214048

(51) Int. Cl.
*A63B 53/04* (2006.01)
*A63B 53/06* (2006.01)

(52) U.S. Cl. ..... 473/332; 473/338

(58) Field of Classification Search ..... 473/324–350
See application file for complete search history.

(56) References Cited

U.S. PATENT DOCUMENTS 1,167,387 A * 1/1916 Beat ..... 473/337
1,518,316 A * 12/1924 Ellingham ..... 473/337
1,538,312 A * 5/1925 Beat ..... 473/337
1,607,284 A * 11/1926 Kraeuter ..... 473/332
1,913,821 A * 6/1933 Stumpf ..... 473/338
2,163,091 A * 6/1939 Held ..... 473/338
2,198,981 A * 4/1940 Sullivan ..... 473/338
3,652,094 A * 3/1972 Glover ..... 473/337
3,909,005 A * 9/1975 Piszel ..... 473/248
4,043,563 A * 8/1977 Churchward ..... 473/338
4,052,075 A * 10/1977 Daly ..... 473/338
4,085,934 A * 4/1978 Churchward ..... 473/338
4,411,430 A * 10/1983 Dian ..... 473/337
4,695,054 A * 9/1987 Tunstall ..... 473/338
4,828,266 A * 5/1989 Tunstall ..... 473/336
5,154,424 A * 10/1992 Lo ..... 473/338
5,316,305 A * 5/1994 McCabe ..... 473/332
5,533,730 A * 7/1996 Ruvang ..... 473/251
5,632,694 A * 5/1997 Lee ..... 473/336
6,089,994 A * 7/2000 Sun ..... 473/338
6,458,044 B1 * 10/2002 Vincent et al. ..... 473/334
6,592,468 B2 * 7/2003 Vincent et al. ..... 473/334
6,592,469 B2 * 7/2003 Gilbert ..... 473/350
6,616,547 B2 * 9/2003 Vincent et al. ..... 473/334

(Continued)

FOREIGN PATENT DOCUMENTS

JP 2001000606 A * 1/2001

(Continued)

*Primary Examiner*—Alvin A Hunter
(74) *Attorney, Agent, or Firm*—Muncy, Geissler, Olds & Lowe, PLLC

(57) ABSTRACT

A golf club head includes a body and a retaining element removably mounted to the body. The retaining element includes a main body and an annular wall extending from a side of the main body of the retaining element. The annular wall defines a compartment for receiving a weight that is retained to the body of the golf club head by the retaining element. A vibration absorbing washer is received in the compartment of the retaining element and mounted to the weight. The vibration absorbing washer absorbs vibration during swing, thereby enhancing assembling reliability of the weight.

16 Claims, 4 Drawing Sheets

U.S. PATENT DOCUMENTS

| | | | | |
|---|---|---|---|---|
| 6,648,772 | B2 * | 11/2003 | Vincent et al. | 473/334 |
| 6,773,360 | B2 | 8/2004 | Willett et al. | |
| 6,811,496 | B2 * | 11/2004 | Wahl et al. | 473/334 |
| 7,048,647 | B2 * | 5/2006 | Burrows | 473/334 |
| 7,108,609 | B2 | 9/2006 | Stites et al. | |
| 7,121,956 | B2 * | 10/2006 | Lo | 473/335 |
| 7,354,355 | B2 * | 4/2008 | Tavares et al. | 473/329 |
| 2002/0068645 | A1 * | 6/2002 | Vincent et al. | 473/338 |
| 2003/0013545 | A1 * | 1/2003 | Vincent et al. | 473/332 |
| 2004/0092332 | A1 * | 5/2004 | Willett et al. | 473/338 |
| 2006/0089206 | A1 * | 4/2006 | Lo | 473/334 |
| 2006/0178229 | A1 * | 8/2006 | Liang et al. | 473/334 |
| 2007/0129163 | A1 * | 6/2007 | Solari | 473/336 |
| 2007/0129164 | A1 * | 6/2007 | Shimazaki et al. | 473/338 |
| 2007/0149316 | A1 * | 6/2007 | Nishino | 473/335 |
| 2008/0009366 | A1 * | 1/2008 | Lo | 473/335 |
| 2008/0132353 | A1 * | 6/2008 | Hsiao | 473/336 |

FOREIGN PATENT DOCUMENTS

| | | | | |
|---|---|---|---|---|
| JP | 2002011124 | A | * | 1/2002 |
| JP | 2006000435 | A | * | 1/2006 |
| JP | 2006081862 | A | * | 3/2006 |
| JP | 2006122334 | A | * | 5/2006 |
| JP | 2006187489 | A | * | 7/2006 |
| JP | 2006198251 | A | * | 8/2006 |
| JP | 2006239154 | A | * | 9/2006 |

* cited by examiner

GOLF CLUB HEAD HAVING REMOVABLE WEIGHT

BACKGROUND OF THE INVENTION

1. Field of the Invention

The present invention relates to a golf club head and, more particularly, to a golf club head having a removable weight.

2. Description of Related Art

U.S. Pat. No. 6,773,360 discloses a golf club head having a weight assembly removably mounted in a recess on a sole of a main body of the golf club head. The recess bottom defines a threaded opening. The weight assembly includes a mass element received in the recess, a screw, and a retaining element. The mass element includes a recess for receiving the retaining element. The screw is extended through an aperture of the mass element and threadedly engaged with the threaded opening of the recess bottom of the main body. The retaining element has outer threads for engaging with internal threads in the recess of the mass element to retain the screw head in the recess of the main body. The weight assembly allows adjustment in the center of gravity of the golf club head to improve swing stability for the golfer.

However, when striking a golf ball with the ball striking face of the golf club head, the vibration generated is imparted to the screw and thus causes loosening or even disengagement of the screw and the mass element. The engaging reliability and assembly between the mass element and the main body deteriorate.

OBJECTS OF THE INVENTION

The primary object of the present invention is to provide a golf club head having a removable weight with improved engaging reliability while allowing adjustment in the center of gravity of the golf club head.

Another object of the present invention is to provide a golf club head having a removable weight that allows easy assembly and easy replacement of the weight.

SUMMARY OF THE INVENTION

To achieve the aforementioned objects, the present invention provides a golf club head including a body; a retaining element removably mounted to the body, with the retaining element including a main body and an annular wall extending from a side of the main body of the retaining element, with the annular wall defining a compartment; a weight received in the compartment of the retaining element and retained to the body of the golf club head by the retaining element; and a vibration absorbing washer received in the compartment of the retaining element and mounted to the weight, with the vibration absorbing washer absorbing vibration during swing, thereby enhancing assembling reliability of the weight.

In an example, the body of the golf club head includes a sole having a recess for receiving the retaining element. In another example, the body of the golf club head includes a skirt having a recess for receiving the retaining element.

Preferably, a peripheral wall defining the recess includes inner threading, and the annular wall of the retaining element includes outer threading for threadedly engaging with the inner threading.

Preferably, a bottom wall defining the recess includes a positioning hole. The weight includes a flange on an outer periphery thereof. The flange of the weight has a diameter greater than that of the positioning hole. An end of the weight extends through the positioning hole of the bottom wall. The vibration absorbing washer is mounted around the weight and sandwiched between the flange and the bottom wall defining the recess.

Preferably, a second vibration absorbing washer is mounted around the weight and sandwiched between the flange and the main body of the retaining element.

Preferably, the main body of the retaining element includes a positioning hole through which the other end of the weight extends.

Preferably, the main body of the retaining element further includes at least two tool coupling holes in a side thereof for assembling or detaching the retaining element to or from the recess.

The weight may be made of metal powders and elastomeric resin. The vibration absorbing washer may be made of rubber or polyurethane.

Other objects, advantages and novel features of this invention will become more apparent from the following detailed description when taken in conjunction with the accompanying drawings.

DETAILED DESCRIPTION OF THE PREFERRED EMBODIMENTS

Figure 1:
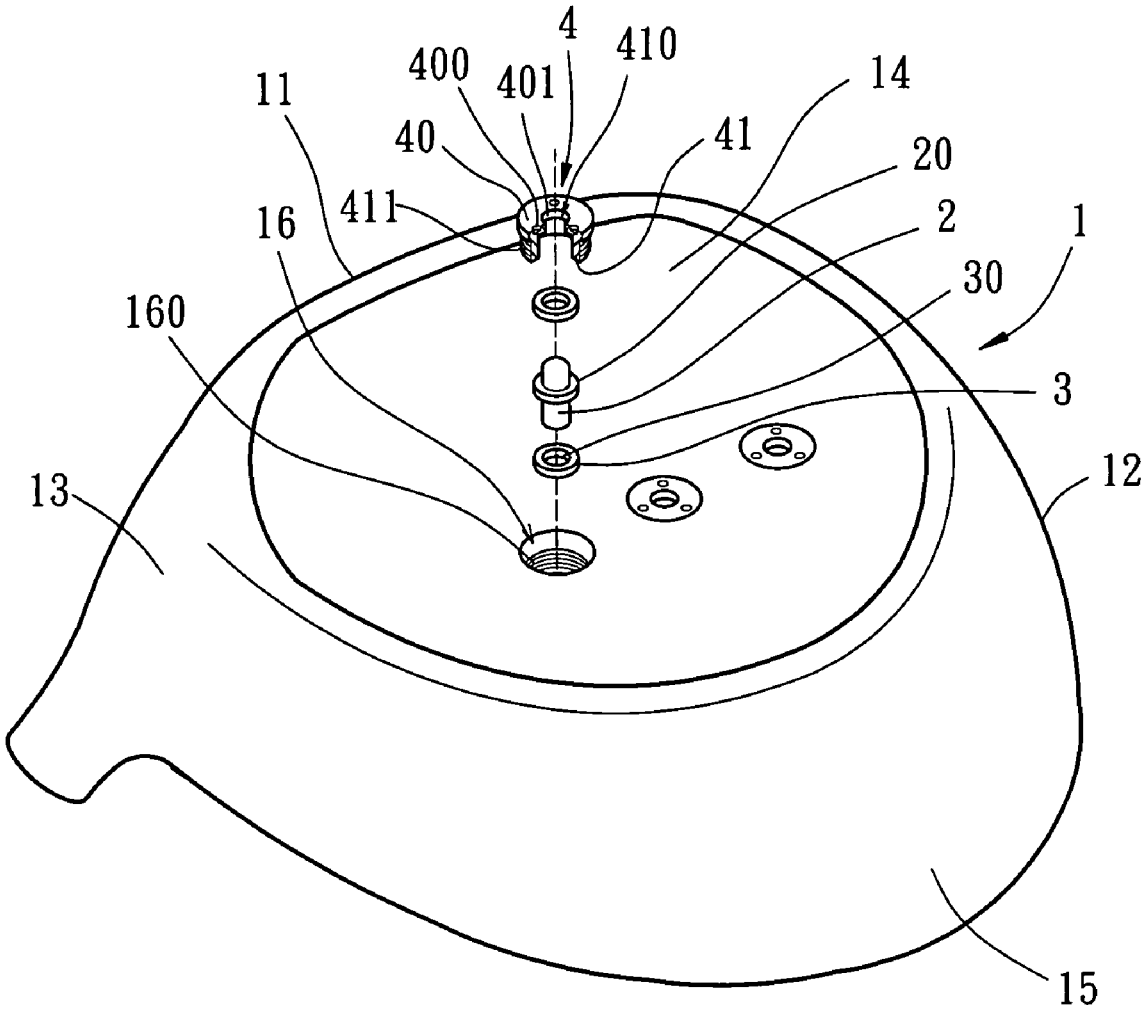
FIG. 1 is an exploded perspective view of a first embodiment of a golf club head having a removable weight in accordance with the present invention.
Figure 2:
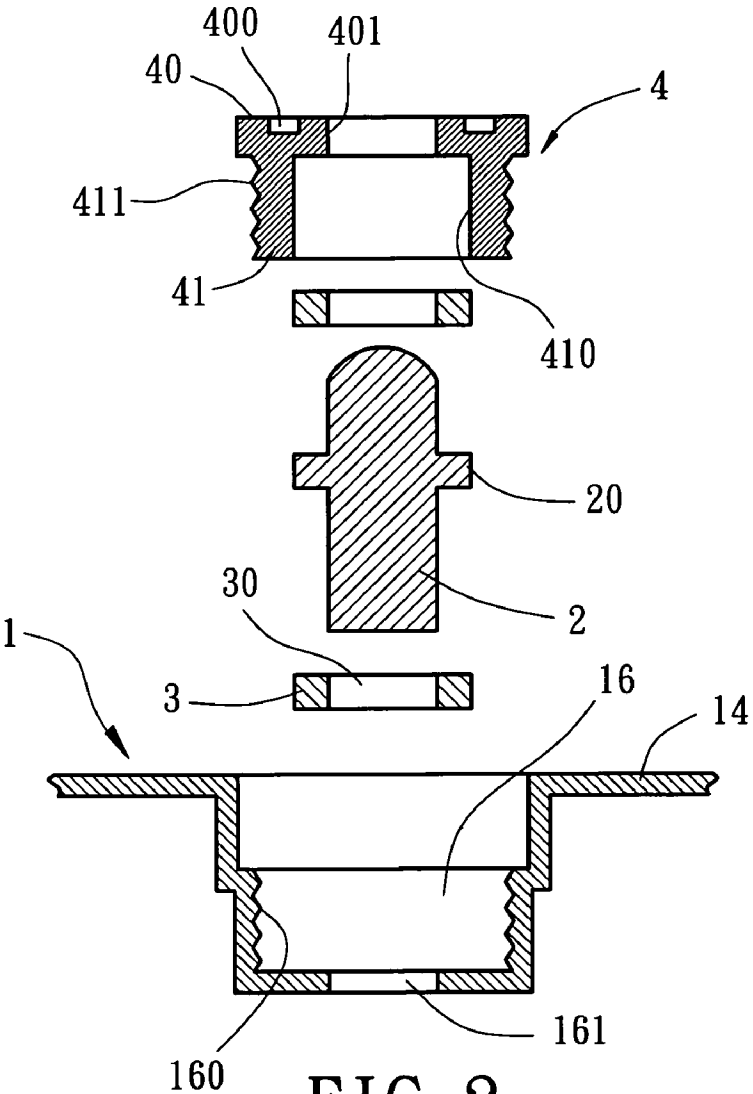
FIG. 2 is an exploded sectional view of a portion of the golf club head of FIG. 1.

Referring to FIGS. 1 and 2, a first embodiment of a golf club head in accordance with the present invention includes a body 1, a weight 2, at least one vibration absorbing washer 3 (two in this embodiment), and a retaining element 4. In this embodiment, the golf club head is of wood type that can be made of a single material by integral formation or composed of a plurality of parts. The body 1 includes a striking face 11, a toe 12, a heel 13, a crown (not shown), a sole 14, and a skirt 15. A recess 16 is defined in the sole 14 and includes inner threading 160 in a peripheral wall thereof. A bottom wall defining the recess 16 includes a positioning hole 161.

Still referring to FIGS. 1 and 2, the weight 2 of the first embodiment is preferably cylindrical or polygonal in section. The weight 2 includes a flange 20 on a part of an outer periphery thereof and between two ends of the weight 2. The flange 20 has a diameter greater than that of the positioning hole 161 of the recess 16. Thus, the weight 2 is prevented from falling into an interior of the body 1 after an end of the weight 2 is extended through the positioning hole 161 of the recess 16. The weight 2 is made of a material having a larger specific weight, such as W—Fe—Ni alloy, carbon steel, low-carbon steel, stainless steel, alloy steel, low-alloy steel, martensite steel, cast iron, nickel-based alloy or non-metal materials. The specific weight of the weight 2 can be greater or smaller than that of the body 1 to provide different weighting effects. Furthermore, the size and material for the weight 2 can be selected to adjust the center of gravity of the body 1. Furthermore, the material of the weight 2 may include metal powders and elastomeric resin to provide vibration absorbing effect. It can be however appreciated that the weight 2 of the present invention can be made of any conventional metal or non-metal materials for making golf club heads.

Still referring to FIGS. 1 and 2, the vibration absorbing washers 3 are preferably made of elastomeric materials such as rubber or polyurethane. Each vibration absorbing washer 3 includes an assembling hole 30 in a center thereof and mounted to and abutting against a side of the flange 20. Preferably, the vibration absorbing washers 3 are respectively mounted to two sides of the flange 20 to enhance the vibration absorbing effect.

Still referring to FIGS. 1 and 2, the retaining element 4 of the first embodiment includes a main body 40 having a positioning hole 401 in a center thereof for the weight 2 to protrude, and an user can conveniently check and choose a suitable weight 2. At least two coupling holes 400 are defined in a side of the main body 40 for coupling with a tool (not shown) for the purposes of assembling or detaching the retaining element 40. An annular wall 41 extends from the other side of the main body of the retaining element 40 and defines a compartment 410 for receiving the other end of the weight 2 and the vibration absorbing washers 3. An outer thread 411 is formed on an outer periphery of the annular wall 41 for threadedly engaging with the inner thread 160 of the recess 16.

Figure 3:
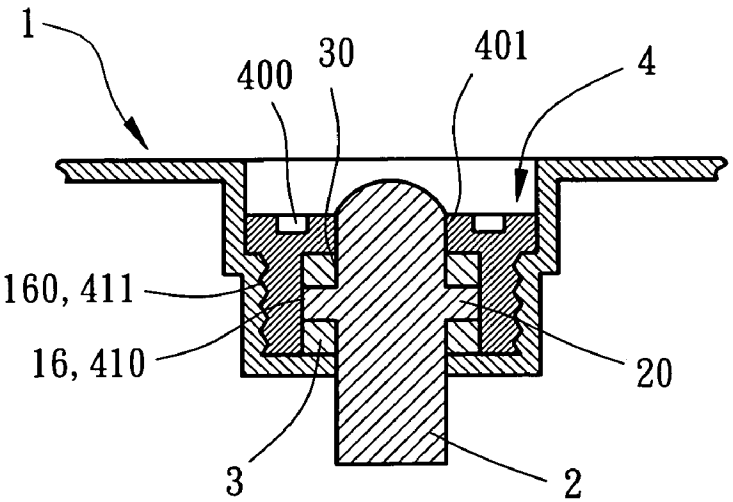
FIG. 3 is a sectional view of the golf club head of FIG. 3 after assembly.

With reference to FIG. 3, in assembly, the vibration absorbing washers 3 are mounted around the weight 2 and respectively abut against two sides of the flange 20 of the weight 2 which is then placed into the compartment 410 of the retaining element 4, with one of the vibration absorbing washers 3 securely sandwiched between the flange 20 and the retaining element 4, and with an end (the upper one in FIGS. 2 and 3) of the weight 2 extending beyond the positioning hole 401 of the retaining element 4. The other end (the lower one in FIGS. 2 and 3) of the weight 2 is then extended through the positioning hole 161 of the recess 16. A tool is coupled with the tool coupling holes 400 of the retaining element 4 to threadedly engage the outer threading 411 of the retaining element 4 with the inner thread 160 of the recess 16 until the other vibration absorbing washer 3 is securely sandwiched between the bottom wall of the recess 16 and the flange 20 of the weight 2. The vibration absorbing washers 3 are capable of directly absorbing and, hence, reducing the striking stress imparted to the golf club head. The vibration absorbing effect of the body 1 is, thus, enhanced. By providing the vibration absorbing washers 3 and the retaining element 4, the adjusting flexibility, assembling reliability, and replacement convenience of the weight 2 are greatly improved. Furthermore, the engaging reliability between the weight 2 and the body 1 is enhanced.

Figure 4:
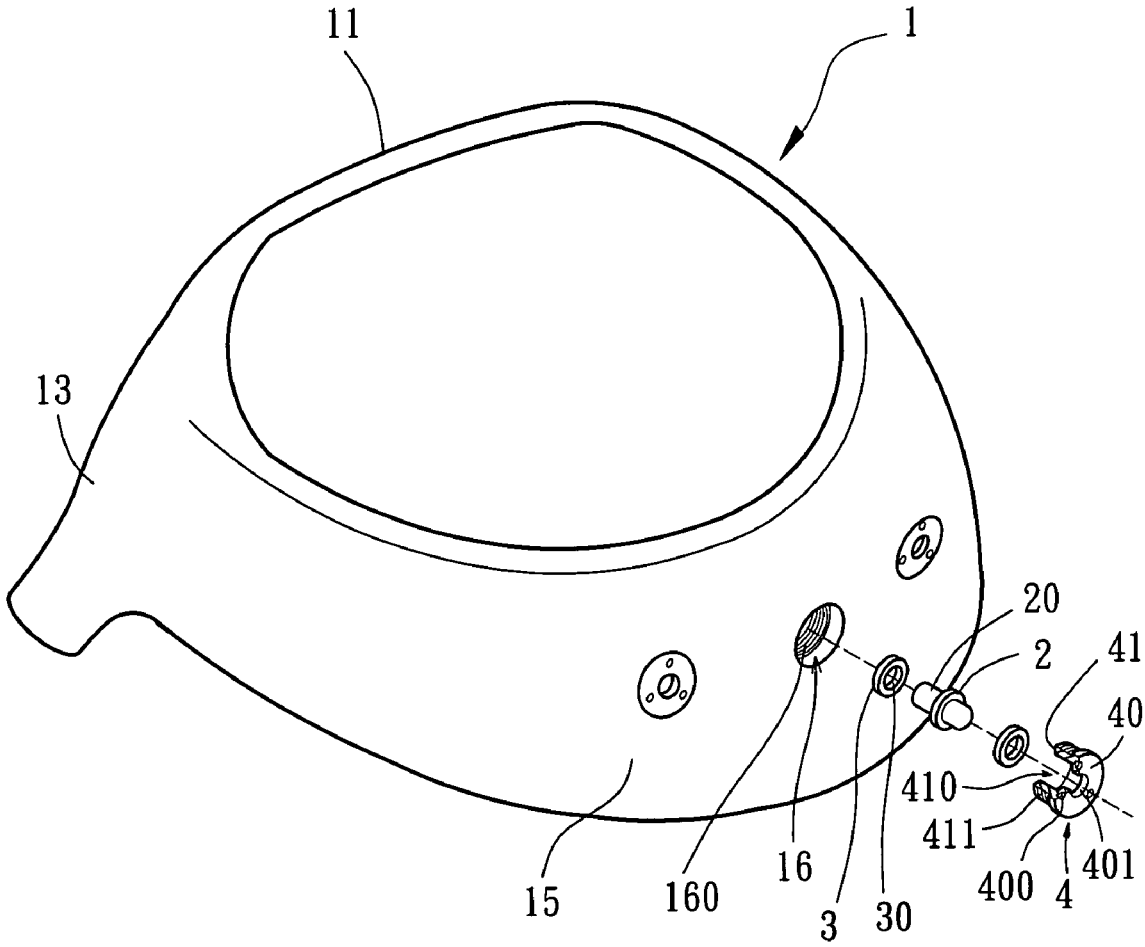
FIG. 4 is an exploded perspective view of a second embodiment of the golf club head in accordance with the present invention.

FIG. 4 shows a second embodiment of the present invention in which the body 1 is also of wood type. In this embodiment, a plurality of recesses 16 are defined in the skirt 15 of the body 1. The recesses 16 may be cylindrical or of any suitable shapes and extend inward into the interior of the body 1. At least one of the recesses 16 is defined in a rear portion of the skirt 15. A weight 2 is mounted in each recess 16 by a retaining element 4, allowing adjustment of the center of gravity of the golf club head to a position adjacent to the skirt 15 and enhancing the engaging reliability between the weight 2 and the body 1 while improving the adjusting flexibility, assembling reliability, and replacement convenience of the weight 2.

Figure 5:
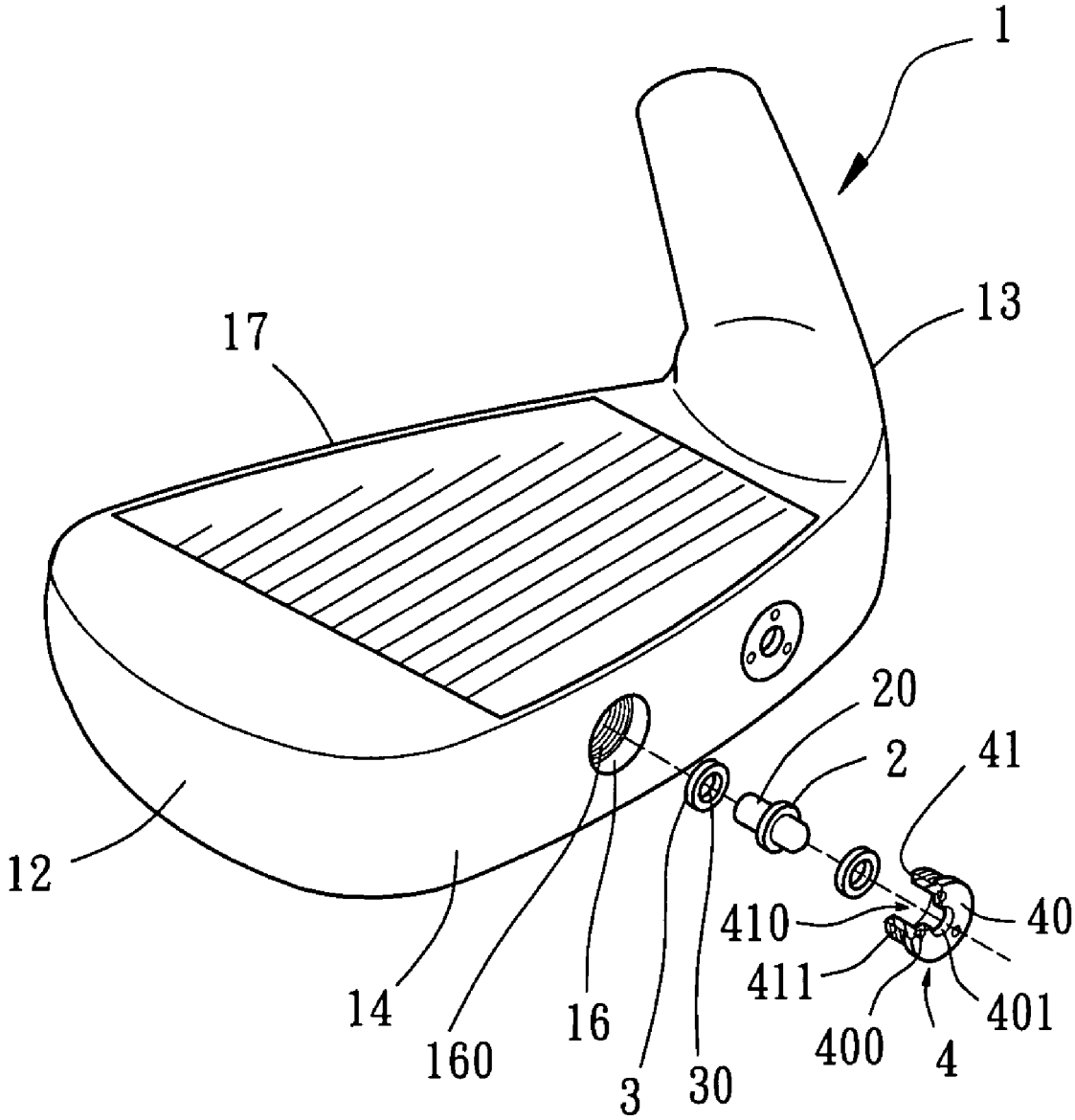
FIG. 5 is an exploded perspective view of a third embodiment of the golf club head in accordance with the present invention.

FIG. 5 shows a third embodiment of the present invention in which the body 1 is of iron type including a ball striking portion (not shown), a toe 12, a heel 13, a blade 17, and a sole 14. In this embodiment, a plurality of recesses 16 are defined in the sole 14 of the body 1. The recesses 16 may be cylindrical or of any suitable shapes and extend inward into the interior of the body 1. A weight 2 is mounted in each recess 16 by a retaining element 4, allowing adjustment of the center of gravity of the golf club head to a position adjacent to a rear portion of the sole 14 and enhancing the engaging reliability between the weight 2 and the body 1 while improving the adjusting flexibility, assembling reliability, and replacement convenience of the weight 2.

While the principles of this invention have been disclosed in connection with specific embodiments, it should be understood by those skilled in the art that these descriptions are not intended to limit the scope of the invention, and that any modification and variation without departing the spirit of the invention is intended to be covered by the scope of this invention defined only by the appended claims.

What is claimed is:

1. A golf club head comprising:

a body having a recess, with a bottom wall defining the recess including a positioning hole, and with a peripheral wall defining the recess including an inner thread;

a retaining element removably mounted to the body, with the retaining element including a main body and an annular wall extending from a side of the main body of the retaining element, with the annular wall defining a compartment, and with the annular wall of the retaining element including an outer thread for threadedly engaging with the inner thread of the body;

a weight received in the compartment of the retaining element and retained to the body of the golf club head by the retaining element, with the weight including a flange on an outer periphery thereof, with the flange of the weight having a diameter greater than that of the positioning hole of the bottom wall, with an end of the weight extending through the positioning hole, and with the flange of the weight abutting against the bottom wall defining the recess; and at least one vibration absorbing washer received in the compartment of the retaining element and mounted to a side of the weight, with the vibration absorbing washer absorbing vibration during swing, thereby enhancing assembling reliability of the weight.

2. The golf club head as claimed in claim 1, with the body of the golf club head including a sole having the recess, and with the retaining element being received in the recess.

3. The golf club head as claimed in claim 2, with the annular wall of the retaining element being engaged in the recess.

4. The golf club head as claimed in claim 2, with the vibration absorbing washer being mounted around the weight and sandwiched between the flange and the bottom wall defining the recess.

5. The golf club head as claimed in claim 4, further comprising a second vibration absorbing washer mounted around the weight and sandwiched between the flange and the main body of the retaining element.

6. The golf club head as claimed in claim 5, with the main body of the retaining element including a positioning hole through which another end of the weight extends.

7. The golf club head as claimed in claim 1, with the main body of the retaining element further comprising at least two tool coupling holes in a side thereof for assembling or detaching the retaining element to or from the recess.

8. The golf club head as claimed in claim 1, with the main body of the retaining element including a positioning hole through which an end of the weight extends.

9. The golf club head as claimed in claim 1, with the body of the golf club head including a skirt having the recess, and with the retaining element being received in the recess.

10. The golf club head as claimed in claim 9, with the annular wall of the retaining element being engaged in the recess.

11. The golf club head as claimed in claim 9, with the vibration absorbing washer being mounted around the weight and sandwiched between the flange and the bottom wall defining the recess.

12. The golf club head as claimed in claim 11, further comprising a second vibration absorbing washer mounted around the weight and sandwiched between the flange and the main body of the retaining element.

13. The golf club head as claimed in claim 12, with the main body of the retaining element including a positioning hole through which another end of the weight extends.

14. The golf club head as claimed in claim 13, with the main body of the retaining element further comprising at least two tool coupling holes in a side thereof for assembling or detaching the retaining element to or from the recess.

15. The golf club head as claimed in claim 1, with the weight being made of metal powders and elastomeric resin.

16. The golf club head as claimed in claim 1, with the vibration absorbing washer being made of rubber or polyurethane.

* * * * *